United States Patent [19]

Komurasaki

[11] Patent Number: 4,625,689

[45] Date of Patent: Dec. 2, 1986

[54] INTERNAL COMBUSTION ENGINE IGNITION SYSTEMS

[75] Inventor: Satoshi Komurasaki, Hyogo, Japan

[73] Assignee: Mitsubishi Denki Kabushiki Kaisha, Tokyo, Japan

[21] Appl. No.: 745,384

[22] Filed: Jun. 17, 1985

Related U.S. Application Data

[63] Continuation of Ser. No. 463,418, Feb. 3, 1983, abandoned.

[30] Foreign Application Priority Data

Feb. 3, 1982 [JP] Japan ..... 57-16709
Feb. 3, 1982 [JP] Japan ..... 57-16710

[51] Int. Cl.[4] ..... F02P 5/145

[52] U.S. Cl. ..... 123/335; 123/198 DC; 123/609

[58] Field of Search ..... 123/334, 335, 198 DC, 123/418, 609

[56] References Cited

U.S. PATENT DOCUMENTS

| | | | |
|---|---|---|---|
| 3,601,103 | 8/1971 | Swiden | 123/335 |
| 4,198,933 | 4/1980 | Sieber et al. | 123/335 |
| 4,297,977 | 11/1981 | Boyama | 123/335 |
| 4,344,395 | 8/1982 | Kondo et al. | 123/335 |
| 4,385,617 | 5/1983 | Nakata et al. | 123/334 |
| 4,459,951 | 7/1984 | Tobinaga et al. | 123/198 DC |

FOREIGN PATENT DOCUMENTS

| | | | |
|---|---|---|---|
| 2810665 | 9/1979 | Fed. Rep. of Germany | 123/609 |

*Primary Examiner*—Willis R. Wolfe, Jr.
*Attorney, Agent, or Firm*—Sughrue, Mion, Zinn, Macpeak and Seas

[57] ABSTRACT

An r.p.m. limiter for an internal combustion engine operates by gradually reducing the output voltage of the ignition coil until it reaches a point where ignition fails until the r.p.m. is reduced to a predetermined value.

7 Claims, 11 Drawing Figures

FIG. 1
(PRIOR ART)
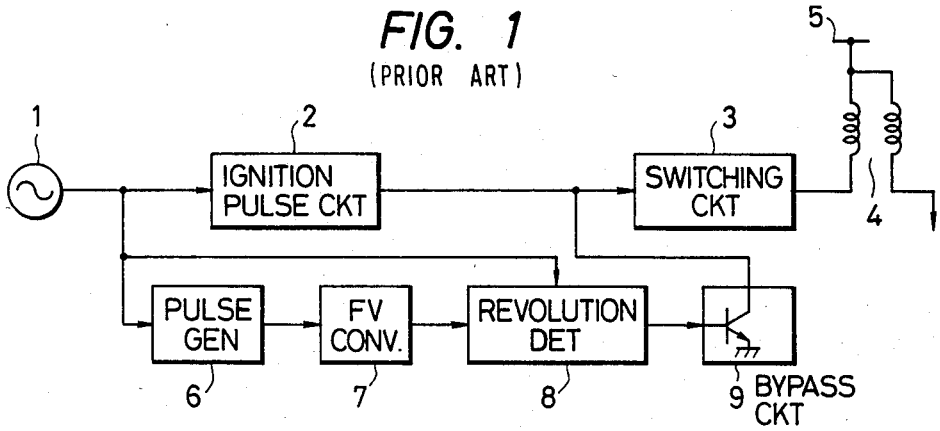
FIG. 2(A)
(PRIOR ART)
FIG. 2(B)
(PRIOR ART)
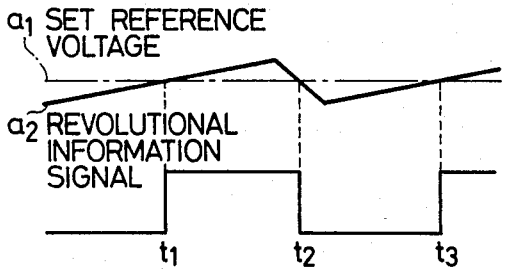
FIG. 3
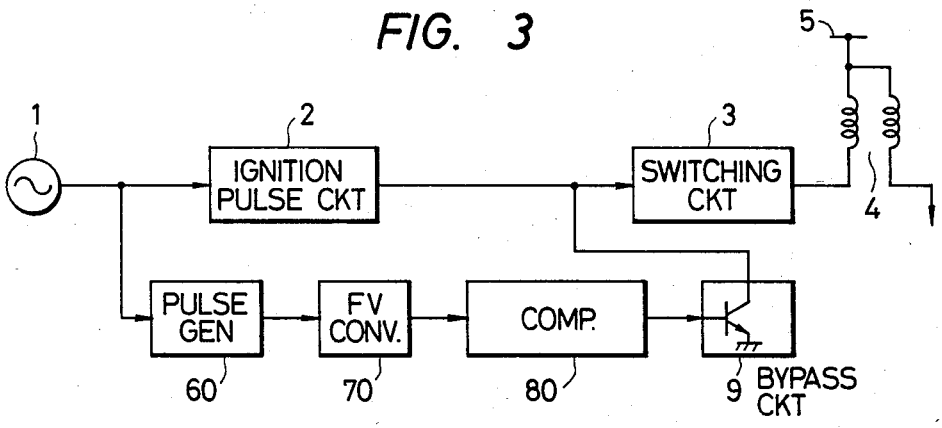

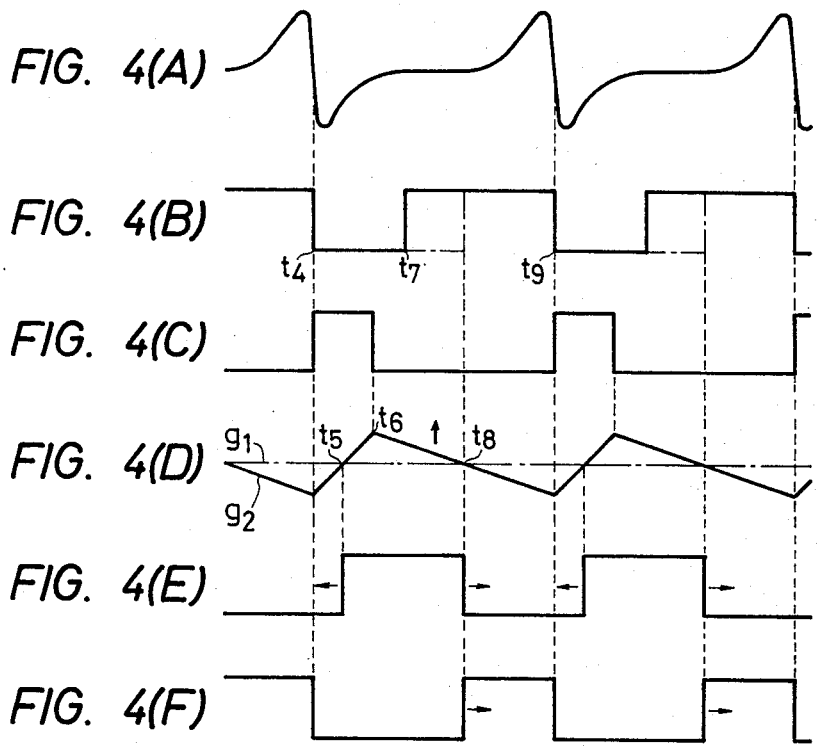
FIG. 5
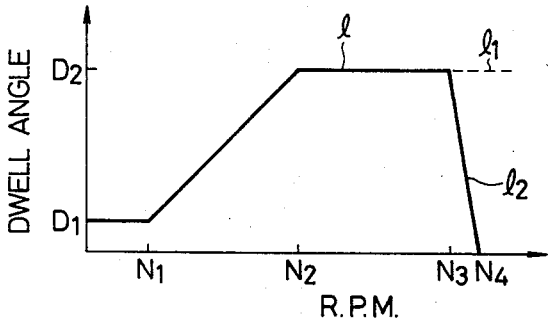

INTERNAL COMBUSTION ENGINE IGNITION SYSTEMS

This is a continuation of application Ser. No. 463,418, filed Feb. 3, 1983, now abandoned.

BACKGROUND OF THE INVENTION

The present invention relates to an improvement in an internal combustion engine ignition system and, more particularly, to the prevention of excessive engine revoltion speeds.

Since an internal combustion engine of the high power type is frequently run in a high r.p.m. range, there is a fear that the engine may break down if driven at an abnormally high r.p.m. For this reason, high power internal combustion engines are generally possessed of an excessive r.p.m. prevention function so that the engine r.p.m. may not exceed a predetermined value.

As one method of preventing excessivc r.p.m., it is known to temporarily interrupt the operations of the ignition system.

One system according to the prior art will be described in the following, with reference to FIGS. 1 and 2.

In FIG. 1, reference numeral 1 indicates an ignition signal generator for generating an ignition signal in accordance with the r.p.m. of the internal combustion engine. Indicated at numeral 2 is an ignition pulse circuit for processing the ignition signal from the ignition signal generator 1 to shape the waveform thereof and to control the dwell angle to thereby generate ignition pulses. Indicated at numeral 3 is a switching circuit for interrupting the power supply to a later-described ignition coil 4 in response to the ignition pulses from that ignition pulse circuit 2. The ignition coil 4 is equipped at one end with a power source terminal 5 for supplying electric power, and is adapted to be driven to generate an ignition voltage by the switching circuit 3. Indicated at numeral 6 is a pulse generator for generating a pulse signal of a predetermined time width in response to the ignition signal from the ignition signal generator 1. Indicated at numeral 7 is an FV converter which is made receptive of the pulse signal from the pulse generator 6 to generate a revolution information signal at a level proportional to the r.p.m. of the engine. The FV converter 7 may be constructed, for example, such that it charges or discharges a capacitor in response to the pulse signal from the pulse generator 6 to thereby generate a d.c. voltage at a level according to the engine r.p.m. at that time. Indicated at numeral 8 is a revolution detector for comparing the level of the revolution information signal from the FV converter 7 to generate an ignition interrupting pulse in synchronism with the ignition signal from the ignition signal generator 1 when the revolution information signal exceeds a reference level. Indicated at numeral 9 is a bypass circuit connected between the output terminal of the aforementioned ignition pulse circuit 2 and an earth potential and which is made operative to bypass the ignition pulses from the ignition pulse circuit to earth in response to the ignition interrupting pulse from the aforementioned revolution detector 8.

FIG. 2 is a waveform chart showing the operational waveforms of the respective units of FIG. 1. FIG. 2(A) shows the level-compared operational waveform of the revolution detector 8, and character $a_1$ indicates a set reference voltage whereas character $a_2$ indicates the revolution information signal from the FV converter 7. Moreover, FIG. 2(B) shows the waveforms of the ignition and interruption pulses of the output of the revolution detector 8.

An explanation of the operation of this device will be made in the following. First of all, the ignition operation will be described. The ignition signal generated by the ignition signal generator 1 in accordance with the r.p.m. of the internal combustion engine in fed to the ignition pulse circuit 2. This circuit shapes the waveform and controls the dwell angle of the ignition signal to thereby generate ignition pulses of a pulse width having such a proper dwell angle as accords with the the running state of the engine. The input pulses thus generated are fed to the switching circuit 3. The circuit controls the power supply to the ignition coil 4 in accordance with the ignition pulses. As a result, when the power supplied to the ignition coil 4 is interrupted, there is generated a high voltage at the secondary side of the ignition coil 4, by which the engine is ignited and run.

Next, the ignition interrupting operation will be described. The pulse generator 6 generates a pulse signal of a predetermined time width in response to the aforementioned ignition signal generated by the ignition signal generator 1. The resultant pulse signal is fed to the FV converter 7, by which it is converted into a revolution information signal at a level proportional to the engine r.p.m. This FV converter 7 may operate, for example, to charge or discharge a capacitor in accordance with the pulse signal from the pulse generator 6 thereby to generate a revolutional information signal having a d.c. voltage at a level according to the engine r.p.m. at that time. The revolution information signal has its level compared with the reference voltage by the revolution detector 8.

This comparing operation will now be described with reference to FIG. 2(A). Here, the reference voltage $a_1$ is at a constant level whereas the revolutional information signal $a_2$ is a signal at a level proportional to the engine r.p.m. such that it rises with a rise in engine r.p.m. The revolution information signal $a_2$ exceeds the reference voltage $a_1$ at a time $t_1$. At this time, the revolution detector 8 generates an ignition interrupting pulse in synchronism with the aforementioned ignition signal, as is shown in FIG. 2(B). These ignition interrupting pulses are fed to the bypass circuit 9, which operates in accordance with the ignition interrupting pulses to thereby bypass the ignition pulses, normally fed from the ignition pulse circuit 2 to the switching circuit 3, to earth. As a result, the switching circuit 3 has no input so that its switching operation is interrupted to interrupt the control of the power supply to the ignition coil 4. As a result, no ignition voltage is generated at the output of the ignition coil 4 so that the engine is not fired but is brought into a misfiring state, in which its r.p.m. is reduced. As a result, the revolution information signal $a_2$ drops until it becomes lower than the reference voltage $a_1$. At this time $t_2$, the revolution detector 8 ceases to generate the ignition interrupting pulses, and the bypass circuit 9 ceases its bypass function so that the ingition pulses from the ignition pulse circuit 2 are again fed to the switching circuit 3. As a result, this switching circuit reopens the power supply to the ignition coil 4 so that the ignition voltage is generated at the secondary side of the ignition coil 4 to cause ignition and run the engine.

Moreover, if the engine r.p.m. again rises until the aforementioned revolution information signal $a_2$ again exceeds the reference voltage $a_1$, the aforementioned ignition interrupting operations are repeated, as indicated at time $t_3$ in FIG. 2(B). Thus, the engine r.p.m. is controlled on an average at a predetermined value by alternating igniting operations and ignition interrupting operations.

Here, since the aforementioned revolution detector 8 generates ignition interrupting pulses in synchronism with the ignition signal from the ignition signal generator 1, the bypass passage 9 has its operation blocked during power supply to the ignition coil 4 so that it is possible to prevent ignitions at an instant when the ignition angle is abnormally advanced, and to prevent the engine from being adversely affected by the ignition interruption operations.

Despite the desired prevention of excessive r.p.m. conducted by the system thus far described according to the proir art, however, operations are alternately effected by the ignition operations continuing for a certain period and by the misfiring operations resulting from the reliable interruptions of the ignition operations. As a result, the operational characteristics highly hunt so that high vibrations are caused in the vehicle driven by the engine. This invites a defect in that drivability and the comfortability are deteriorated, and also in that an abnormally abrupt and uncontrollable deceleration is caused by large-scale vibrations at the start of the ignition interrupting operations. Moreover, since a complete interruption of the ignition operation is conducted as the excessive r.p.m. preventing operation, there arises another defect in that a vehicle equipped with a tachometer for indicating engine r.p.m. on the basis of the signal at the drive termianl of the ignition coil will have its indicator jumping so highly as to make the driver anxious.

SUMMARY OF THE INVENTION

The present invention has been conceived so as to eliminate the above-specified defects concomitant with the system of the prior art and contemplates the provision of an internal combustion engine ignition system which can reduce vibrations during the running operation.

BRIEF DESCRIPTION OF THE DRAWINGS

FIG. 1 is a block circuit diagram showing a system according to the prior art;

FIGS. 2A and 2B are a chart showing operational waveforms of the device of FIG. 1;

FIG. 3 is a block diagram showing one embodiment of the present invention;

FIGS. 4A–4F a chart showing operational waveforms of the respective units of FIG. 3; and FIG. 5 is a graph showing one example of the dwell angle reducing characteristic.

DETAILED DESCRIPTION OF THE PREFERRED EMBODIMENTS

One embodiment of the present invention will be described in the following with reference to FIGS. 3 to 5. In FIG. 3, reference numeral 60 indicates a pulse generator for generating pulses of a predetermined width from the ignition time in response to the ignition signal from the ignition signal generator 1. Indicated at numeral 70 is an FV converter which is made operative to charge or discharge a capacitor, for example, in synchronism with the pulses from pulse generator 60. For example, the capacitor may have its time constant set at a small value such that its charging or discharging waveforms have a level changing generally in a triangular form in accordance with the phase of the pulses. Indicated at numeral 80 is a comparator for comparing the output of that FV converter 70 with a reference voltage at a predetermined level to thereby generate ignition interrupting pulses. The operation of the remaining elements are similar to those of the like numbered elements of the system of the prior art, and thus a detailed description thereof is omitted.

The operation of the device will be described in the following. The ignition circuit system composed of the ignition signal generator 1, the ignition pulse circuit 2, the switching circuit 3 and the ignition coil 4 is similar to that of the aforementioned system of the prior art, and a description of its operations are accordingly omitted. The ignition interrupting operation will be described in the following.

The ignition signal generated by the ignition signal generator 1 in accordance with the revolution of the engine is a signal having a waveform such as is shown in FIG. 4(A). The ignition pulses prepared by the ignition pulse circuit 2 on the basis of this ignition signal form a waveform as shown in FIG. 4(B). Times $t_4$ and $t_9$ are respectively ignition times, and the period from time $t_4$ to time $t_9$ is the ignition period, midway of which there is located at a time $t_7$ when power supply to the ignition coil 4 is started. In other words, power supply to the ignition coil 4 is not conducted during the period from the ignition time $t_4$ to the time $t_7$ but is started from the time $t_7$, and the power supply current is interrupted at time $t_9$ so that the engine is ignited. The pulse generator 60 generates pulses of a predetermined period from the ignition times, i.e., the times $t_4$ and $t_9$. The pulses thus generated form a signal which is, as shown in FIG. 4(C), a pulse continuing from the time $t_4$ for a predetermined time to a time $t_6$. In accordance with this pulse, the FV converter 70 charges or discharges the capacitor.

The waveform $g_2$ shown in FIG. 4(D) is output from the FV converter 70, the level of which is raised by the charging action of the capacitor during the period from the time $t_4$, when the pulses are fed from the pulse generator 60, to the time $t_6$, and is lowered by the discharging action of the capacitor during the period from time $t_6$ to $t_9$ when no pulse is fed. The charging and discharging actions of the capacitor are repeated in the aforementioned manner until the output level of the FV converter 70 is balanced about a level according to the repetition period. In short, the output waveform $g_2$ has a ripple in the ignition period with its minimum at the ignition time (i.e., the time $t_4$) and its maximum at the time $t_6$ after the lapse of the predetermined period. The average of these levels is determined by the repetition period of the aforementioned charging and discharging operations such that it is enlarged as the repetition period becomes shorter, namely, as the engine r.p.m. becomes higher, since the width of the pulses from the pulse generator 60 is held constant.

The comparator 80 compares the output of the FV converter 70 with a preset reference voltage. This comparing operation will be described with reference to FIG. 4(D). The waveform $g_1$ shown in FIG. 4(D) represents the preset reference voltage. When the aforementioned output of the FV converter 70, as indicated by the waveform $g_2$, exceeds the reference voltage $g_1$, ignition interrupting pulses are generated.

The average of the output $g_2$ of the FV converter 70 is enlarged in accordance with the rise in engine r.p.m., as described above. With rising engine r.p.m., therefore, the output $g_2$ has its level exceeding the reference voltage $g_1$ at its peak (i.e., at the time $t_6$) and its average enlarged accordingly. As a result, the period during which the output $g_2$ is higher than the reference voltage $g_1$ will shift about the time $t_6$, extending over the period from the time $t_5$ to a time $t_8$.

As a result, the ignition interrupting signal at the output of the comparator 80 becomes a pulse signal extending from the time $t_5$ to the time $t_8$, as shown in FIG. 4(E). The width of these pulses extends a distance to either side of the time $t_6$ in accordance with the engine r.p.m., as described above.

In response to the ignition interrupting pulses shown in FIG. 4(E), the bypass circuit 9 operates to bypass the ignition pulses of the output of the ignition pulse circuit 2, as shown in FIG. 4(B), to earth for the portion of the ignition period $t_4$ to $t_9$ extending from $t_5$ to $t_8$. As a result, the input to the switching circuit 3 has a waveform such as shown in FIG. 4(F). In other words, the power supply period of the ignition coil 4 extends from the time $t_8$ to the time $t_9$. Here, since the time $t_8$ approaches the time $t_9$ in accordance with the rise in engine r.p.m., the ignition coil 4 has its power supply period gradually shortened until it receives no power supply.

In proportion to the reduction in the supply period of the ignition coil 4, specifically the ignition voltage of the output of the same drops until it takes a value of zero.

One example of the characteristics of the dwell angle versus the r.p.m. will be described in the following with reference to FIG. 5. In this figure, the ordinate designates the dwell angle, which is plotted against engine r.p.m. As shown, the dwell angle is held constant at $D_1$ for an engine r.p.m. lower than $N_1$, is controlled to increase from $D_1$ to $D_2$ for r.p.m.'s from $N_1$ to $N_2$, and is held constant at $D_2$ for an r.p.m. higher than $N_2$.

According to the characteristics of the system of the prior art, the dwell angle is held substantially constant at the value $D_2$, as indicated by a characteristic curve $l_1$ extrapolated from the characteristic curve l, even for speeds exceeding an r.p.m. $N_3$.

According to the system of the present embodiment, on the contrary, the dwell angle drops for speeds exceeding the predetermined r.p.m. $N_3$ due to the aforementioned controlling operation, until it takes a value of zero at an r.p.m. $N_4$. In other words, the characteristic curve is changed from the curve l so as to follow a characteristic curve $l_2$ for speeds from $N_3$ to $N_4$.

Incidentally, the r.p.m. $N_3$, at which the reduction or retarding of the dwell angle is begun is set at around 5,000 r.p.m. or more for a higher powered engine of the relatively low r.p.m. type.

Now, if control is exercised to shorten the power supply period of the ignition coil 4, i.e., to reduce the dwell angle in accordance with the rise in engine r.p.m., as has been described above, to thereby lower the ignition voltage, this voltage drops from a high ignition voltage as is required for sparking to a level lower than the minimum required, whereupon the ignition plug misfires to reduce the r.p.m. of the engine. When engine r.p.m. drops, the dwell angle is then increased so that the ignition voltage of the output of the ignition coil 4 is gradually raised until it exceeds the required voltage of the ignition plug, whereupon ignition takes place to increase engine r.p.m.

When the r.p.m. is again increased, the ignition voltage again becomes lower than that required by the plug to cause misfiring. By fine repetitions of the sequence of ignition and misfiring due to the changes in the ignition voltage, the engine reaches a balance at a predetermined r.p.m. so that it can be prevented from reaching excessive speeds.

In the excessive speed prevention process, the drop rate of the igntion voltage with respect to the engine r.p.m. exerts a large influence upon vibrations generated during running of the engine when the aforementioned dwell angle is reduced to drop the ignition voltage in accordance with a rise in engine r.p.m. As a result, in the characteristic of the dwell angle shown in FIG. 5, the revolution width between the engine r.p.m. $N_3$, where the reduction in the angle is started, and the engine r.p.m. $N_4$ where the dwell angle takes the value zero, plays an important role. Tests conducted by the inventors have succeeded in confirming that riding comfortability and drivability are improved where the above-noted revolution width exceeds 50 r.p.m. in terms of the engine r.p.m., and are adversely affected when the r.p.m. width is made lower than that value.

Since the ignition coil is driven even when the engine enters the misfiring state, moreover, the signal waveform at the driven terminal of the ignition coil is substantially the same as that during normal operation, so that a tachometer indicating engine r.p.m. on the basis of that signal exhibits a correct r.p.m. indication similarly as in normal operation.

As has been described hereinbefore, according to the present invention, since there is provided a means of reducing the dwell angle of the ignition coil during its power supply period in accordance with an increase in r.p.m. of the internal combustion engine, an excessive engine speed is prevented, and the secondary voltage of the output of the ignition coil is gradually dropped in accordance with the revolution speed of the internal combustion engine. As a result, a fine sequence of ignition and misfiring can be repeatedly effected so that vibrations during the ignition interruping operation can be reduced to a remarkable extent, to thereby improve drivability and riding comfortability and to prevent an abrupt acceleration or deceleration. In a vehicle having a tachometer driven by the signal at the drive terminal of the ignition coil, moreover, the tachometer can be stably operated even during misfiring so that its indicator can be prevented from jumping. Since the dwell angle is reduced over a revolution range exceeding 50 r.p.m., there can be attained an additional effect that drivability and riding comfortability can be remarkably improved.

What is claimed is:

1. An internal combustion engine ignition system, of the type including an ignition coil, comprising; pulse generator means for generating pulses of a predetermined width in response to an ignition signal, ignition pulse circuit means for generating ignition pulses in response to said ignition signal, converter means for converting said pulses of said pulse generator means into waveforms of a variable level, comparator means for comparing said variable level with a reference value, and means responsive to an output of said comparator for reducing an output voltage of said ignition coil in a graduated manner, said comparator responsive means including means for increasingly inhibiting the supply of power to said ignition coil in response to increasing engine r.p.m. above a predetermined engine r.p.m. level, by increasingly shortening an effective period of said ignition pulses.

2. An internal combustion engine ignition system, as set forth in claim 1, said converting means comprising capacitive means charging during said pulses.

3. An internal combustion engine ignition system, comprising; an ignition pulse generator for generating ignition pulses in synchronism with the revolution of an internal combustion engine, driving means for controlling the supply of power to an ignition coil in accordance with the ignition pulses generated by said ignition pulse generator; and means for gradually reducing a dwell angle of said ignition coil in a power supply period of said ignition coil in accordance with an increase in the r.p.m. of said internal combustion engine, by gradually reducing the time during which power is supplied to said ignition coil, said dwell angle reducing means comprising means for progressively shortening an effective period of application of said ignition pulses to said driving means, said dewll angle being reduced from a predetermined value to a minimum value within a predetermined engine r.p.m. range.

4. An internal combustion engine ignition system as set forth in claim 3, said dwell angle reducing means being operable to reduce the dwell angle over an r.p.m. range equal to or greater than 50 r.p.m. above a predetermined r.p.m. level.

5. An internal combustion engine ignition system as set forth in claim 3, said dwell angle reducing means being operable to reduce said dwell angle to zero.

6. An internal combustion engine ignition system as set forth in claim 3, wherein said dwell angle reducing means includes pulse generator means for generating pulses of a predetermined time width in synchronism with ignition timing; signal converter means for converting the pulse signal of said pulse generator means into an output signal having a level which varies in accordance with the phase of said pulses; comparator means for comparing the output signal of said signal converter means with a reference value; and dwell angle controller means for controlling the dwell angle of said ignition coil within the power supply period of said ignition coil in response to an output signal of said comparator means.

7. An internal combustion engine ignition system, as set forth in claim 6, wherein said output signal of said comparator means comprises an ignition interrupt pulse, power being supplied to said coil for a period of time beginning with the fall of said ignition interrupt pulse and continuing to an ignition time, said period of time decreasing in response to an increase in a pulse width of said ignition interrupt pulse corresponding to an increase in the magnitude of said output signal of said signal converter means.

* * * * *